United States Patent [19]

Sheets

[11] 4,010,901

[45] Mar. 8, 1977

[54] PROJECTABLE LAWN SPRINKLER

[76] Inventor: Kerney T. Sheets, P.O. Box 637, Duplessis, La. 70728

[22] Filed: Mar. 1, 1976

[21] Appl. No.: 662,827

[52] U.S. Cl. ..... 239/204; 239/230; 239/288.3

[51] Int. Cl.[2] ..... B05B 15/10

[58] Field of Search ..... 239/104, 203–206, 239/230, 288, 288.3, 288.5, 602

[56] References Cited

UNITED STATES PATENTS

| | | | |
|---|---|---|---|
| 1,605,242 | 11/1926 | Keys | 239/206 |
| 2,013,849 | 9/1935 | Keys | 239/206 |
| 3,104,822 | 9/1963 | Muschett | 239/206 |
| 3,309,025 | 3/1967 | Malcolm | 239/230 |

*Primary Examiner*—Robert S. Ward, Jr.
*Attorney, Agent, or Firm*—David L. Ray

[57] ABSTRACT

A projectable lawn sprinkler which rises automatically from the ground when water pressure is applied to the sprinkler. The sprinkler includes a housing, a pipe rigidly connected to the housing, a projectable conduit connected to the pipe, a projectable cover rigidly connected to the projectable conduit, and a sprinkler head attached to the projectable conduit.

22 Claims, 4 Drawing Figures

PROJECTABLE LAWN SPRINKLER

BACKGROUND OF THE INVENTION

The present invention relates to sunken lawn sprinklers which are automatically projected or advanced to a position above the surrounding ground level when water pressure is applied to the sprinkler.

Many parks and schools, athletic fields, golf courses, and residences are installing automatic irrigation systems to provide adequate moisture for landscaping and to maintain vast acres of lawn inter to a high degree of perfection. In such applications the pop-up type of sprinkler heads have been found most desirable to facilitate ground maintenance. Further, by using pop-up sprinkler heads which retract out of sight when not in use, the hazards associated with permanently elevated obstruction are eliminated. Such hazards include accidents incurred by tripping or falling over the sprinkler, striking the sprinkler with a lawnmower or automobile, and theft of a permanently elevated sprinkler head.

Many forms of projectable sprinklers have been proposed both commercially and in the patent literature. U.S. Pat. Nos. 3,758,038; 3,104,822; 2,611,644; and 2,013,849 disclose various types of pressure operated pop-up sprinklers. By the term "pressure operated" is meant that the lawn sprinklers are projected up by the pressure of the water supplied to the sprinklers. Another method of raising or projecting a sprinkler is disclosed in U.S. Pat. Nos. 3,921,911 and 3,709,435 wherein the projectable lawn sprinklers float upward from the ground.

One difficulty encountered in making a commerically successful pressure operated lawn sprinkler has been the complexity and number of parts required. Some sprinklers are costly to manufacture, difficult to assemble, repair and service, and are unreliable in operation. Furthermore, pressure operated pop-up sprinklers have suffered from the inability to seal well. Poor sealing causes an unnecessary large drop in pressure with the result that fewer projectable sprinklers than permanently raised sprinklers could be used on a supply line of given hydraulic capacity.

A further problem encountered in prior art, projectable lawn sprinklers was that to prevent the stand pipe projected from the ground from rocking, it was necessary to have the relatively movable parts fit one another quite closely and to have lengthy bearing surfaces, i.e., lands. However, when the parts fit closely, natural friction develops and foreign matter tends to stick between the parts. This sometimes jams the stand pipe, and at other times scores the parts so as to permit leakage to develop. Furthermore, the use of long lands requires additional force to raise the stand pipe, and it is therefore more vulnerable to jamming.

An additional problem encountered in pressure operated pop-up sprinklers is the need to control the rate at which the sprinkler rises. If the sprinkler head rises rapidly when water pressure is applied to the sprinkler, the projectable casing can strike the stationary casing with great impact which could cause possible damage to the sprinkler.

Additional disadvantages of some pressure operated projectable lawn sprinklers is that they do not tend to assume and maintain the predetermined substantially vertical position each time they are erected, that they do not erect to great heights because clearances and friction are multiplied when the movement of the stand pipe becomes appreciable, and that grass can grow over the top of the projectable lawn sprinkler and prevent the sprinkler from rising.

THE INVENTION

The projectable lawn sprinkler of the present invention includes a hollow housing, a pipe rigidly connected to the hollow housing, a projectable conduit connected to the pipe, a projectable cover rigidly connected to the projectable conduit, and a sprinkler head connected to the conduit for spraying water.

The invention will be more completely understood by referring to the drawings in which.

Figure 1:
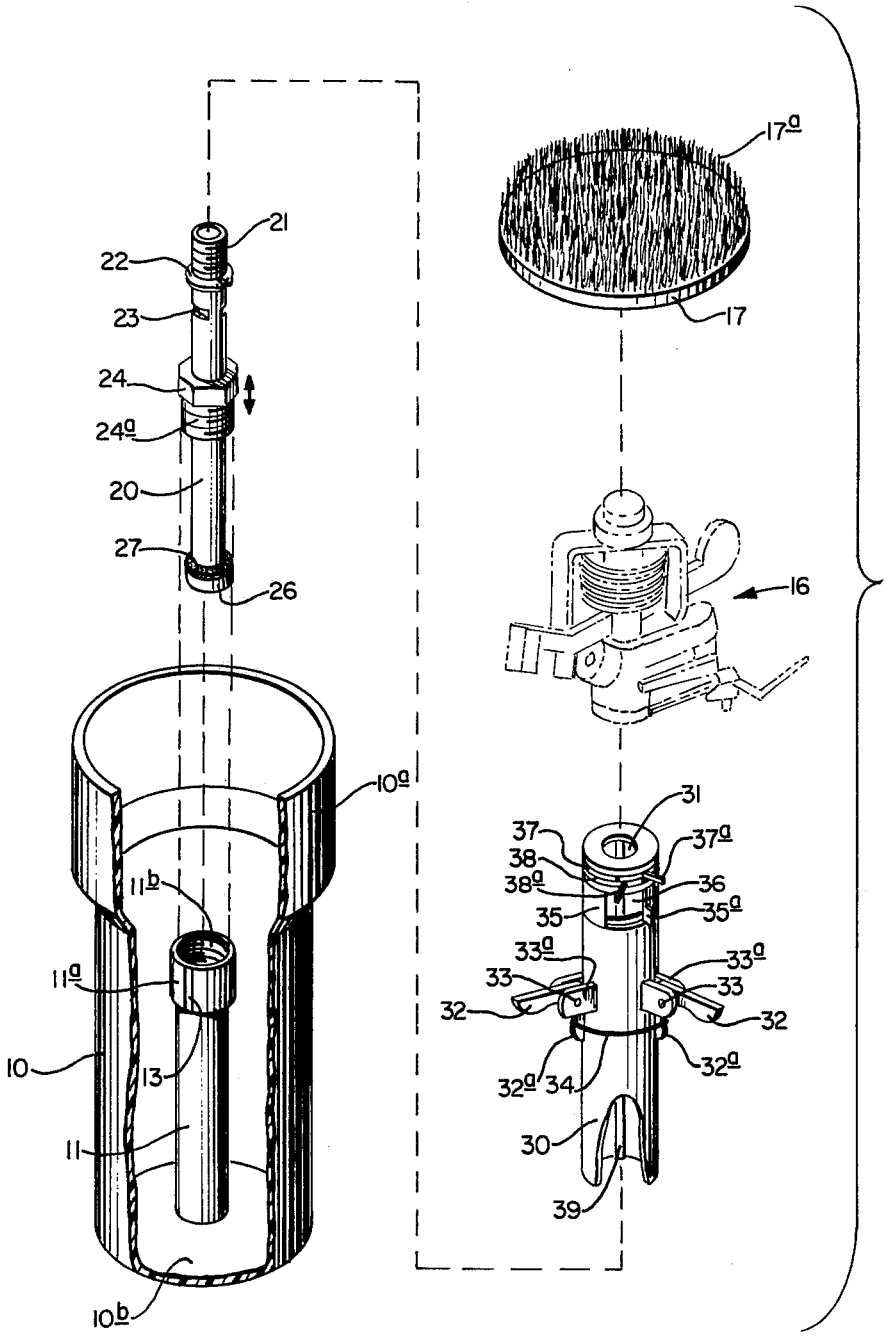
FIG. 1 is a partly sectional, exploded perspective view of the projectable sprinkler.

Referring now to the drawings, the sprinkler can be seen to include a housing 10 having a generally cylindrical bore and an enlarged upper portion 10*a* and base 10*b*. It is not essential that housing 10 include an enlarged portion 10*a* since the diameter of housing 10 could be chosen to enclose the sprinkler head 16, but the construction shown in the drawings is preferred. Preferably, housing 10 has a hole or series of holes (not shown) in the bottom or sides thereof for permitting water to drain out which may collect in the housing.

Rigidly connected to base 10*b* is a generally cylindrical pipe 11 having a generally cylindrical enlarged portion 11*a* at the upper end thereof. As can be best seen in FIG. 1, the enlarged portion 11*a* has a groove 13 thereon and threads 11*b* therein. The bottom of pipe 11 has a hose connected thereto for supplying water to the sprinkler.

Figure 4:
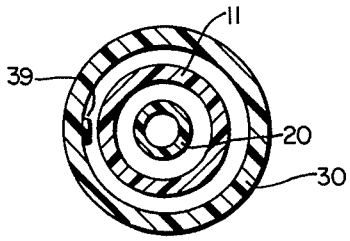
Figure 3:
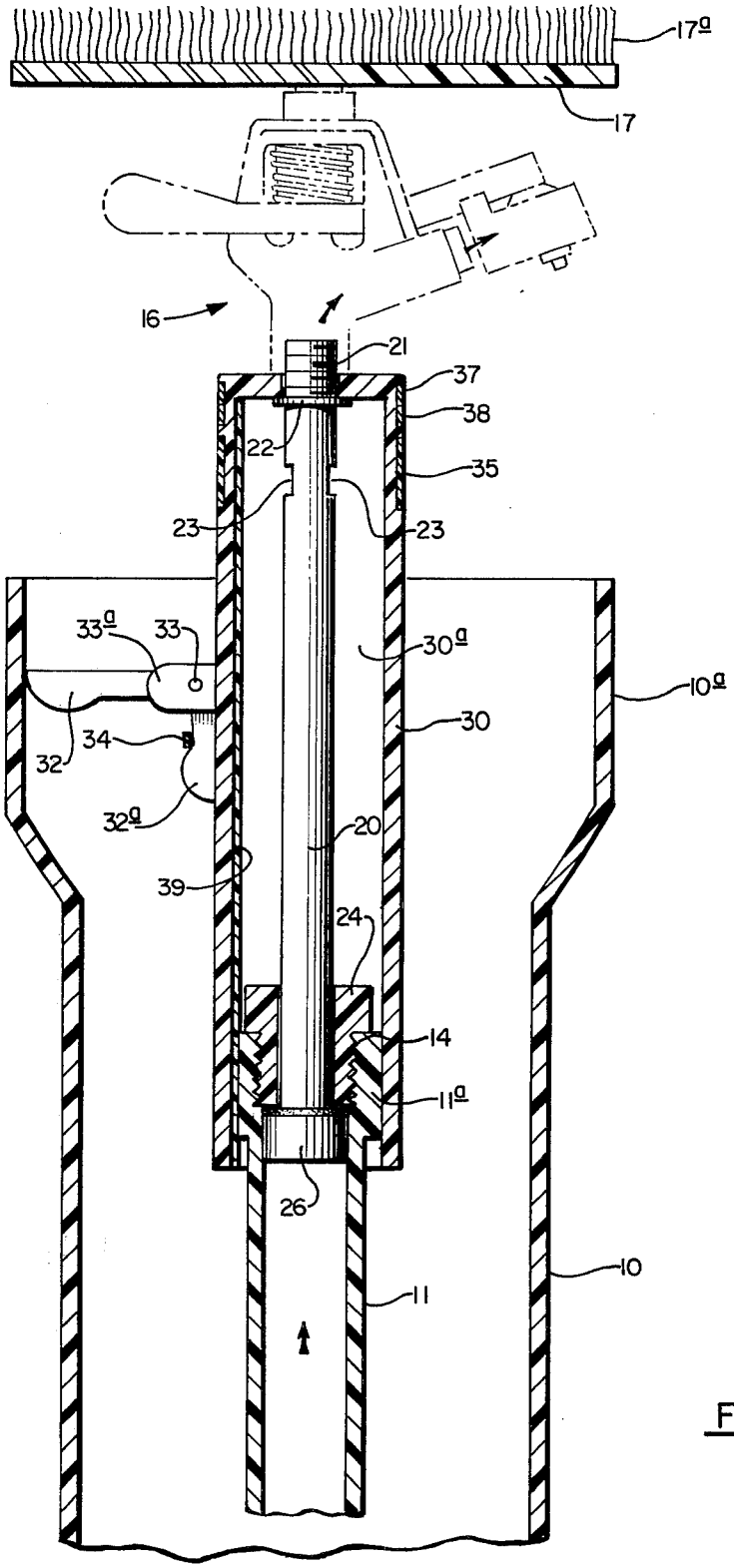
FIG. 3 is a partially cut-away, cross-sectional view of the projectable sprinkler in the projected position; and, FIG. 4 is a cross-sectional view taken along the lines 4—4 of FIG. 2.

As can be seen in FIGS. 1 and 4, projectable conduit 20 is adapted for positioning inside pipe 11. Projectable conduit 20 is hollow inside and has an enlarged portion 26 at the lower end thereof which is slidably received in pipe 11. The enlarged portion 26 is of sufficient diameter to be snuggly received inside of pipe 11 while still being capable of sliding smoothly upward within pipe 11. Located immediately above the enlarged portion 26 is a washer 27 preferably made from a resilient material such as rubber, soft plastic, or the like, which aids in forming a watertight seal to prevent water from pipe 11 from entering the interior of casing 10 when projectable conduit 20 is in the projected or upward position such as is illustrated in FIG. 3. Slidably received about projectable conduit 20 is a fitting 24 having threads 24*a* thereon which are received in threads 11*b* of stationary pipe 11. Fitting 24 limits the upward movement of projectable conduit 24.

At the upper end of projectable conduit 20 are threads 21 onto which sprinkler head 16 is attached. To aid in holding the projectable conduit 20 while screwing sprinkler head 16 thereon, slots 23 may be provided in projectable conduit 20 for engagement by a wrench. A snap ring 22 or other suitable means is attached at the lower end of threads 21 to hold projectable cover 30 between snap ring 22 and sprinkler head 16.

As can be seen in the drawings 1, 2 and 3, projectable cover 30 is rigidly attachable to projectable conduit 20. Projectable cover 30 is generally a hollow cylinder having a groove 39 running longitudinally along its interior wall. Groove 39 is receivable within slot 13 of the enlarged portion 11*a* of pipe 11 and together they prevent projectable cover 30 from rotating about stationary pipe 11. The interior walls of projectable cover 30 slidably engage the outside surface of the enlarged portion 11*a* of pipe 11. The diameter of enlarged portion 11*a* is chosen to snuggly engage the interior walls of cover 30 while permitting cover 30 to easily slide upward when water pressure is applied to pipe 11.

Figure 2:
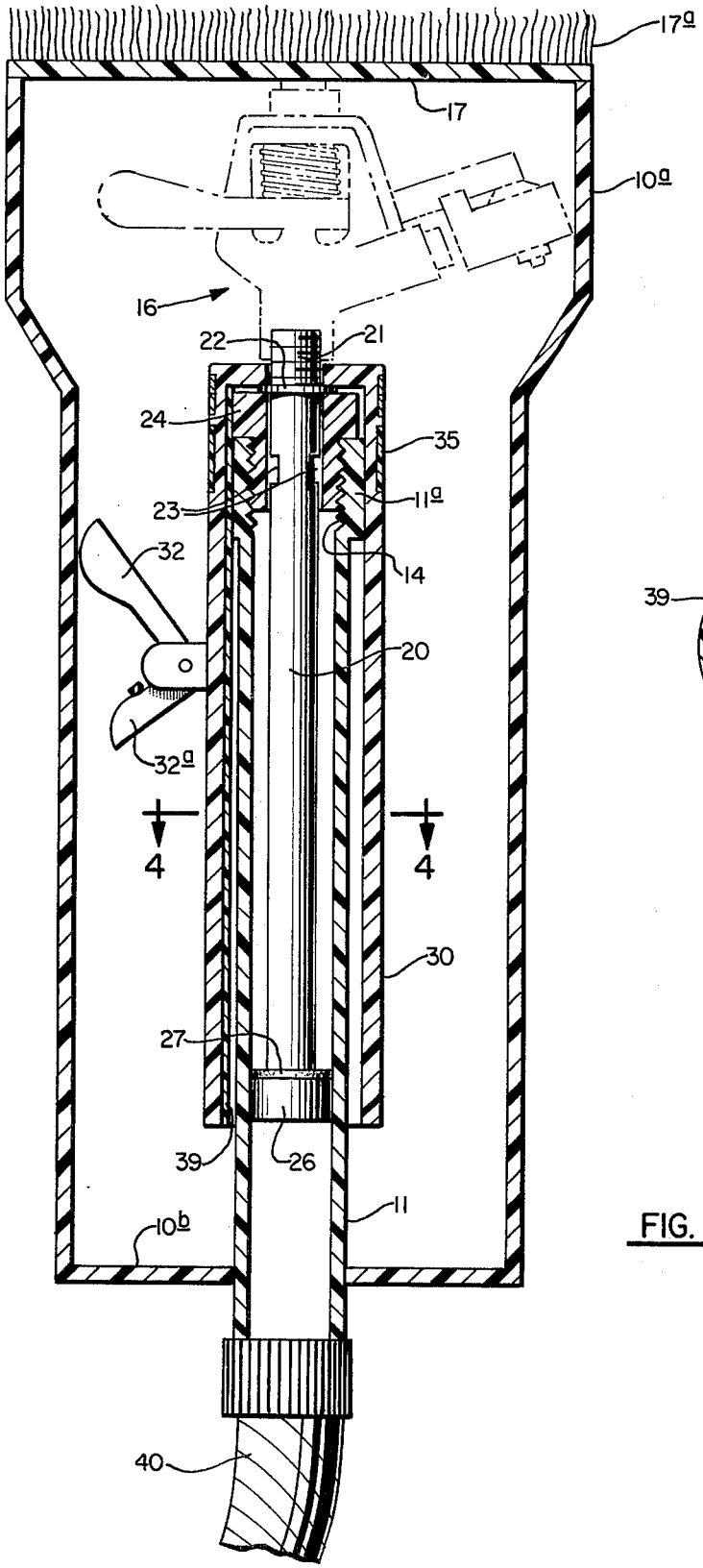
FIG. 2 is a cross-sectional view of the projectable lawn sprinkler in the retracted position.

A series of guides 32 are positioned about the exterior surface of cover 30 to prevent substantial rocking and wobbling of cover 30 and sprinkler head 16 when the sprinkler is fully projected upward. The guides 32 have a bottom leg 32*a* which is molded rigidly with 32. The guides pivot about pins 33 which are received within legs 33*a*. Legs 33*a* are rigidly connected to the outside surface of projectable cover 30. As can be best seen in FIGS. 2 and 3, the guides, preferably three or more in number, pivot about pin 33 as cover 30 travels from the lowered to the raised position. A rubber band 34 is located around the bottom leg 32*a* to bias 32*a* guides against the exterior wall of projectable cover 30. Any suitable means other than a rubber band may be used such as a small coil spring, or the like. Although guides 32 are preferred, they could be eliminated if the length of the outside surface of 11*a* in contact with the inside surface of cover 30 were sufficient to prevent substantial wobbling and rocking of cover 30.

When projectable cover 30 is in the position shown in FIG. 3, the guides 32 contact the inside wall of the enlarged portion 10*a* of housing 10 to hold the cover 30 and sprinkler head 16 rigidly upright. Thus, there is negligible rocking or wobbling of the sprinkler head and projectable cover 30 when the sprinkler head is in the projected position as shown in FIG. 3.

As can be seen in FIG. 1, projectable cover 30 has a hole 36 located in the upper portion thereof, which extends in an arc about the surface of projectable cover 30 sufficiently large to permit a wrench to fit therethrough. A sliding, flat cover ring 35 is located in a groove provided in the upper portion of projectable cover 30 for alignment over hole 36. Ring 35 is sufficiently large to completely cover and seal hole 36 when turned to an appropriate position. Sliding cover ring 35 has a tab 35*a* thereon to facilitate turning ring 35 about projectable cover 30. When sliding cover ring 35 is placed in position so that hole 36 is uncovered, a wrench or other tool may be inserted through hole 36 to engage slots 33 in projectable conduit 20 to prevent projectable conduit 20 from turning while removing or attaching sprinkler head 16. After sprinkler head 16 has been attached, sliding cover ring 35 is positioned over hole 36 to form a substantially air-tight seal over hole 36.

Located above sliding ring 35 in a groove provided on the exterior surface of projectable cover 30 are two sliding trip rings 37 and 38 having tabs 37*a* and 38*a* thereon which can trip the conventional mechanisms on sprinkler head 16 to cause the sprinkler head to turn in an arc dependent upon the location of tabs 37*a* and 38*a*. Such sprinkler heads having mechanisms controlled by tabs such as 37*a* and 38*a* are well-known in the art. Sliding trip rings 37 and 38 could be eliminated if only 360° sprinkling is desired.

A lid 17 is rigidly attached to the top of the sprinkler head 16 by any conventional means. Preferably the lid was a synthetic grass-like material 17*a* attached to the top thereof.

Sprinkler head 16 may be any conventional sprinkler head well-known in the art. Typical of the preferred sprinkler heads are the impact or impulse type similar to that disclosed in U.S. Pat. No. 3,309,025 issued Mar. 14, 1967 to Malcolm which is hereby incorporated by reference.

The operation of the sprinkler will now be described. When water is supplied under pressure to stationary pipe 11 such as by hose 40 shown in FIG. 2, water flows upward in stationary pipe 11 as is indicated by the arrow in FIG. 3, through projectable conduit 20, and outward through sprinkler head 16. The pressure of the water within stationary pipe 11 forces projectable conduit 20 upward into the projected position shown in FIG. 3.

Assuming that sliding cover ring 35 is placed in position over hole 36 to form a substantially air-tight seal about hole 36, air can only enter the interior of projectable cover 30 between the inside wall of projectable cover 30 and the outside surface of the enlarged portion 11*a*, with a small portion being admitted around groove 13 and guide 39. Since there is a snug, sliding fit between the surfaces between which air must enter, the air chamber 30*a* being formed inside of cover 30 as cover 30 is projected upwardly, a damping action is achieved which reduces the speed at which the projectable conduit rises and thereby prevents the enlarged portion 26 of projectable conduit 20 from striking fitting 24 sharply. Thus, the outer cover 30 acts as a shock-absorber or damper to prevent damage to the sprinkler head projectable conduit 20, and cover 30 which could be caused by the severe shock of the system being forced upward rapidly. Furthermore, projectable cover 30 prevents water, abrasive material carried by the water such as dirt and sand from contacting and causing wear to the exterior surface of projectable conduit 20 when the interior of casing 10 becomes filled with water due to heavy rains or flooding.

The various components of the sprinkler of the present invention are preferably made from any suitable plastic material. However, other materials such as metals may be used. Plastics are preferred because of lower weight, lower cost and their resistance to corrosion. The various components of the sprinkler may be molded as one piece when such is feasible. For example, the casing 10 and pipe 11 could be molded as one piece as could cover 30 and projectable conduit 20.

If desired, the cylindrical housing 10 could be made of an eliptical or oval cross-section, or an irregular cross-section. Furthermore, projectable cover 30 and enlarged portion 11*a* of pipe 11 could be made of a similar oval or eliptical, or irregular section if desired.

Having described the invention it is desired that it be limited only within the spirit and scope of the following claims:

I claim:

1. A projectable lawn sprinkler comprising:

a. housing means;

b. pipe means rigidly connected to said housing means;

c. projectable conduit means connected to said pipe means;

d. projectable damper means covering a portion of said pipe means, said projectable damper means being rigidly connected to said projectable conduit means; and, e. means connectecd to said projectable conduit means for spraying water.

2. The lawn sprinkler of claim 1 wherein said housing means is hollow inside, open at the top, and has a generally cylindrical bore.

3. The lawn sprinkler of claim 1 wherein said pipe means is located within said housing means.

4. The lawn sprinkler of claim 1 wherein a portion of said projectable conduit means is contained in said pipe means.

5. The lawn sprinkler of claim 1 wherein said projectable conduit means has an enlarged portion at one end thereof which is contained within said pipe means.

6. The lawn sprinkler of claim 1 wherein said projectable conduit means is connected to said pipe means by fitting means.

7. The lawn sprinkler of claim 1 wherein said projectable conduit means has slot means on the outer surface thereof for engagement by wrench means.

8. The lawn sprinkler of claim 1 wherein said projectable damper means has guide means connected thereto for substantially preventing wobbling and rocking of said damper means.

9. The lawn sprinkler of claim 1 wherein said projectable damper means is generally cylindrical in shape.

10. The lawn sprinkler of claim 1 wherein said projectable damper means has hole means in the wall thereof.

11. The lawn sprinkler of claim 10 wherein said projectable damper means has sliding cover ring means thereon for covering said hole means.

12. The lawn sprinkler of claim 1 wherein said projectable damper means has at least one sliding trip ring means thereon for engaging said means for spraying water.

13. The lawn sprinkler of claim 1 wherein said projectable damper means has means for preventing rotation of said damper about said pipe.

14. A projectable lawn sprinkler comprising:

a. hollow housing means;

b. pipe means located in and rigidly connected to said housing means;

c. projectable conduit means connected to said pipe means, a portion of said conduit means being slidably received in said pipe means;

d. projectable damper means for reducing the speed at which said projectable conduit rises including cover means rigidly connected to said projectable conduit means, said projectable cover means being slidably received over the outside of said pipe means; and, e. means connected to said projectable conduit means for spraying water.

15. The lawn sprinkler of claim 14 wherein said cover means is generally cylindrical in shape and hollow inside.

16. The lawn sprinkler of claim 15 wherein said cover means has guide means connected thereto for substantially preventing wobbling and rocking of said damper means.

17. The lawn sprinkler of claim 15 wherein said cover means has hole means in the wall thereof.

18. The lawn sprinkler of claim 17 wherein said projectable damper means has sliding cover ring means thereon for covering said hole means.

19. The lawn sprinkler of claim 15 wherein said projectable damper means has at least one sliding trip ring means thereon for engaging said means for spraying water.

20. The lawn sprinkler of claim 14 wherein said projectable damper means has means for preventing rotation of said damper about said pipe.

21. The lawn sprinkler of claim 14 wherein said housing means is open at the top, and has a generally cylindrical bore.

22. The lawn sprinkler of claim 14 wherein said projectable conduit means has an enlarged portion at one end thereof which is contained in said pipe means.

* * * * *